US008382260B2

(12) United States Patent
Utzui et al.

(10) Patent No.: US 8,382,260 B2
(45) Date of Patent: Feb. 26, 2013

(54) LIQUID DISCHARGING APPARATUS

(75) Inventors: Syuu Utzui, Odawara (JP); Masaya Uetsuki, Yokohama (JP); Kouhei Tokuda, Yokohama (JP); Hideo Fukazawa, Chigasaki (JP); Hiroaki Shirakawa, Kawasaki (JP); Naoshi Inoue, Machida (JP); Eiichi Adachi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 568 days.

(21) Appl. No.: 12/637,012

(22) Filed: Dec. 14, 2009

(65) Prior Publication Data

US 2010/0155417 A1 Jun. 24, 2010

(30) Foreign Application Priority Data

Dec. 19, 2008 (JP) ..... 2008-324475

(51) Int. Cl.
*B41J 2/175* (2006.01)
*B41J 2/195* (2006.01)

(52) U.S. Cl. ..... 347/85; 347/7

(58) Field of Classification Search ..... 347/7, 84, 347/85, 86

See application file for complete search history.

(56) References Cited

U.S. PATENT DOCUMENTS

2002/0057319 A1 5/2002 Saruta et al.
2008/0084448 A1 * 4/2008 Fukano et al. ..... 347/19

FOREIGN PATENT DOCUMENTS

| | | |
|---|---|---|
| EP | 1114726 | 7/2001 |
| EP | 1757456 | 2/2007 |
| JP | 2001-162833 | 6/2001 |
| JP | 2003-266674 | 9/2003 |
| KR | 10-0441237 B1 | 7/2004 |

* cited by examiner

*Primary Examiner* — Jannelle M Lebron
(74) *Attorney, Agent, or Firm* — Canon USA Inc IP Division

(57) ABSTRACT

A liquid discharging apparatus includes a liquid container having an information storage portion configured to store information and a supply port for supplying liquid in the liquid container to the outside and a movable member having the liquid container attached thereon. After the connection between the supply port and the apparatus is severed while the movable member moves from a first position to a second position, information is written in the information storage portion. The second position is set such that the time required for the movable member to move from the first position to the second position is longer than or equal to the time required for the information communication.

3 Claims, 7 Drawing Sheets

LIQUID DISCHARGING APPARATUS

BACKGROUND OF THE INVENTION

1. Field of the Invention

The present invention relates to liquid discharging apparatuses.

2. Description of the Related Art

Recent liquid containers attached to liquid discharging apparatuses include electrically erasable and programmable read-only memories (EEPROMs) so as to control, for example, the amount of liquid being consumed. Since the EEPROMs serving as information storage portions can store information without being supplied with power, information on the amount of liquid being stored or being consumed can be retained even when the EEPROMs are detached from the liquid discharging apparatuses. However, when the electrical connection is cut while the EEPROMs are in the process of storing information, the information to be retained may be damaged. To avoid this, Japanese Patent Laid-Open Nos. 2001-162833 and 2003-266674, for example, describe methods for preventing electrical disconnection during the process of storing information in EEPROMs.

According to Japanese Patent Laid-Open No. 2001-162833, time required for the process of storing information in EEPROMs is secured by setting a liquid container to be temporarily undetachable when a user attempts to detach the liquid container. As an example of a liquid discharging apparatus using an off-carriage liquid container, Japanese Patent Laid-Open No. 2001-162833 describes a liquid discharging apparatus having a two-stage holder cover. A user cannot detach the liquid container from the apparatus until he/she opens a second holder cover after opening a first holder cover. Storage of information can be finished before the user opens the second holder cover and detaches the liquid container by starting the process of information storage when it is determined that the first holder cover is opened.

Japanese Patent Laid-Open No. 2003-266674 describes a liquid cartridge fixed in position by a positioning supporting unit. FIG. 7A illustrates a lever 154 positioned such that a first end 154*a* thereof is located at the uppermost position, and FIG. 7B illustrates the lever 154 positioned such that the first end 154*a* is located at the lowermost position. The lever 154 can move as can a crank, and when the first end 154*a* is located at the uppermost position, a limit switch 155, which is switched on or off in accordance with the contact position with a guide surface 154*c* of the lever 154, is turned off. In this state, information cannot be stored. At this moment, the liquid container can be detached since a cam 159 is separated from a fitting claw 153*b*. On the other hand, when the lever 154 is positioned such that the first end 154*a* is located at the lowermost position, the limit switch 155 is turned on by the guide surface 154*c*. In this state, information can be stored. At this moment, the cam 159 pushes the fitting claw 153*b* such that the liquid container cannot be detached. In this manner, a user cannot detach the liquid container without moving the first end of the lever 154 from the lowermost position to the uppermost position, and information can be stored while the first end of the lever 154 is moved.

In the case of a large liquid discharging apparatus that prints on large recording media, the liquid discharging apparatus can include an additional auxiliary liquid container inside the apparatus. Recording can be continued for a certain period of time even when a main liquid container is not attached to the apparatus by storing a certain amount of liquid supplied from the main liquid container in the auxiliary liquid container. That is, the main liquid container can be replaced without stopping the recording operation. With the above-described structure having the auxiliary liquid container, the interior of the liquid container is pressurized using a pump such that liquid is pushed out (supply by pressure), or the liquid is sucked from the liquid container using a pump (supply by suction).

However, when it is assumed that the liquid container, having the structure described in Japanese Patent Laid-Open No. 2001-162833 or 2003-266674, which is in use is detached from the apparatus during recording, an error may be generated between the actual amount of liquid being stored in the liquid container and information on the amount of liquid being stored written in the information storage portion of the liquid container. That is, in the case of the known structures, the liquid container is detached after the information on the amount of liquid remaining in the liquid container is stored in the information storage portion. Since the supply port remains connected to the liquid discharging apparatus even after the information storage is finished, the pressure for liquid supply continues to be applied to the liquid container, and liquid continues to be supplied to the head. This may cause an error between the actual amount of liquid being stored in the liquid container and information on the amount of liquid being stored written in the information storage portion of the liquid container, and the amount of liquid being stored may not be correctly obtained.

SUMMARY OF THE INVENTION

The present invention is directed to a liquid discharging apparatus, from which a liquid container is not detached while information is stored in an information storage portion of the liquid container, allowing information not including a large error from an actual amount of liquid being stored to be written in the information storage portion of the liquid container.

According to an aspect of the present invention, a liquid discharging apparatus includes a liquid container including an information storage portion configured to store information on an amount of liquid in the liquid container and a supply port for supplying the liquid in the liquid container to the outside; a communication portion configured to communicate the information between the information storage portion and the liquid discharging apparatus; a supporting member including a supply portion, the supply portion configured to be connected to the supply port and to supply liquid to the liquid discharging apparatus; and a movable member, engaged so as to be movable with respect to the supporting member, having the liquid container attached thereon. The movable member is movable from a first position at which the supply port and the supply portion are connected to each other to a second position at which the liquid container can be attached to or detached from the apparatus. The communication portion communicates the information with the information storage portion after the connection between the supply port and the supply portion is severed while the movable member moves from the first position to the second position. The second position is set such that a time required for the movable member to move from the first position to the second position is longer than or equal to a time required for the information communication.

According to the present invention, even when a main liquid container in use that still contains liquid is detached from the apparatus while the liquid discharging apparatus performs recording, information not including a large error from an actual amount of liquid being stored can be written in the information storage portion of the liquid container. Furthermore, the liquid container can be prevented from being detached from the apparatus while information is stored in the information storage portion.

Further features of the present invention will become apparent from the following description of exemplary embodiments with reference to the attached drawings.

DESCRIPTION OF THE EMBODIMENTS

According to the present invention, information is written in an information storage portion of a liquid container after a connection between a liquid discharging apparatus and the liquid container at a supply port is severed. Subsequently, the liquid container is detached from the apparatus. With this, information that does not include a large error between the amount of liquid being stored in the liquid container and information on the amount of liquid being stored retained in the information storage portion can be written in the information storage portion of the liquid container, and the liquid container can also be prevented from being detached from the liquid discharging apparatus while the information is being written.

1. Liquid Discharging Apparatus

Figure 1:
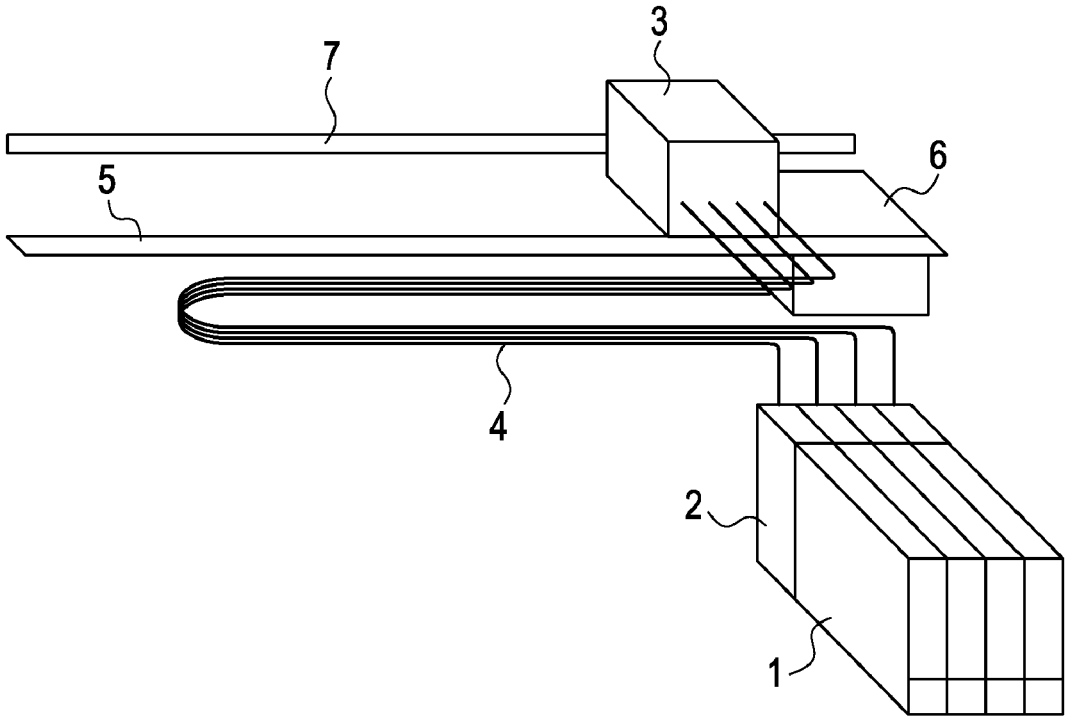
FIG. 1 is a schematic view of a liquid discharging apparatus to which the present invention is incorporated.

FIG. 1 is a schematic view of a liquid discharging apparatus to which the present invention is incorporated. The liquid discharging apparatus includes supporting members 1 that support liquid containers 11 (see FIG. 2) attached to the supporting members so as to be detachable, auxiliary liquid containers 2, a liquid discharge head 3 (hereinafter referred to as "recording head"), liquid supply paths 4, a platen 5, a recovery unit 6, and a guide rail 7.

Liquid such as ink is supplied from the main liquid containers 11 (herein after referred to as simply "liquid containers 11") attached to the supporting members 1 to the auxiliary liquid containers 2. After being temporally stored in the auxiliary liquid containers 2, the liquid is supplied to the recording head 3 via the liquid supply paths 4. Since a certain amount of the liquid is stored in the auxiliary liquid containers 2, the liquid can be supplied from the auxiliary liquid containers 2 to the recording head 3 even when the liquid in the liquid containers 11 runs out. Thus, the liquid containers 11 can be replaced during recording. The recording head 3 is installed in a carriage (not shown) that scans in directions along the guide rail 7, and performs recording by ejecting liquid from ejecting nozzles thereof. Moreover, the recording head 3 cleans the ejecting nozzles by regularly ejecting liquid that is not used for recording to the recovery unit 6.

2. Supporting Member

Figure 2:
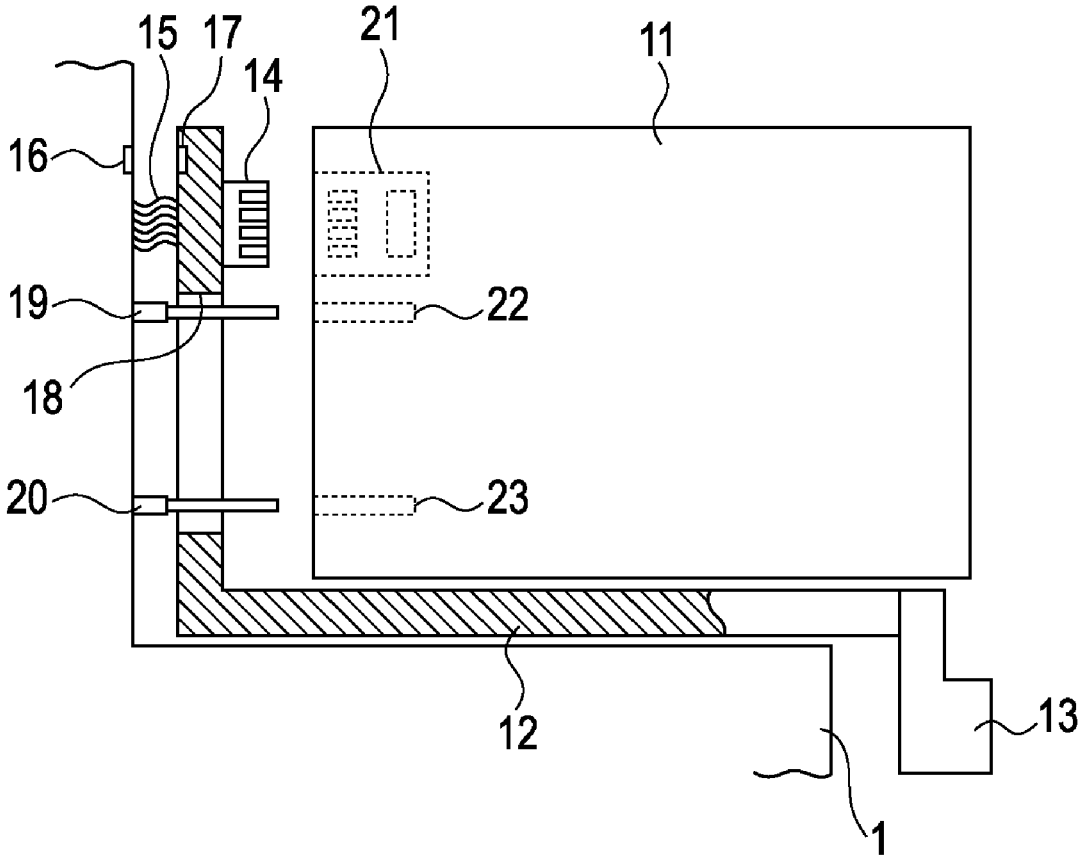
FIG. 2 is a schematic view of a supporting member according to a first exemplary embodiment of the present invention.

FIG. 2 is a schematic view of a supporting member 1 according to a first exemplary embodiment of the present invention. The supporting member 1 includes a supply portion 20 that supplies liquid from the liquid container 11 to the recording head via the auxiliary liquid container and a pressure supply portion 19 that supplies pressure from the main body such that the pressure inside the liquid container 11 is maintained at a predetermined level. The supporting member further includes a wiring member 15 for communicating information between an information storage portion (EEPROM) 21 installed in the liquid container 11 and the main body of the liquid discharging apparatus.

A movable member 12 is disposed on the supporting member 1 so as to be movable.

3. Movable Member

The liquid container 11 is attached on the movable member 12. The liquid container 11 and the supporting member 1 are connected to or disconnected from each other by moving the movable member between a first position and a second position with respect to the supporting member 1 (in the horizontal direction in FIG. 2). The movable member 12 has a knob 13 at an end adjacent to a user so that the user can pull out the movable member 12. The movable member 12 further includes a through-hole 18 through which the supply portion 20 and the pressure supply portion 19 of the supporting member 1 are connected to the liquid container 11. The wiring member 15 provided for the supporting member has a certain length, and is connected to the movable member 12 at a side adjacent to the supporting member 1 so as not to interfere with the movement of the movable member 12. The movable member further includes an information terminal 14 to be connected to the information storage portion of the liquid container 11 at a side of the movable member adjacent to the liquid container 11. The information terminal 14 is connected to the wiring member 15. In this exemplary embodiment, the wiring member 15 and the information terminal 14 serve as a communication portion that communicates information between the information storage portion and the liquid discharging apparatus.

4. Main Liquid Container

The liquid container 11 includes the information storage portion 21 that stores information including the amount of liquid being stored (remaining) or being consumed in the liquid container, a supply port 23, for supplying liquid to outside the container, connected to the supply portion 20 of the supporting member 1 of the liquid discharging apparatus, and a pressure supply port 22 connected to the pressure supply portion 19 of the supporting member 1. The supply portion 20 is connected to a liquid reservoir (not shown) for storing liquid disposed inside the liquid container 11. The liquid reservoir can be, for example, a flexible bag. Liquid can be supplied from the liquid container 11 to the liquid discharging apparatus by supplying pressure from the pressure supply portion 19 to the liquid container such that the interior of the liquid container is pressurized and the liquid reservoir is compressed.

5. Movable Member Detection Mechanism

The disconnection between the supply port 23 and the supply portion 20 can be detected by, for example, a detection mechanism that detects the movement of the movable member 12. The detection mechanism includes a first terminal 16 and a second terminal 17. The first terminal 16 is disposed on the supporting member 1, and the second terminal 17 is disposed on the movable member 12 at a position corresponding to the first terminal. When the movable member 12 is located at the first position, the first terminal 16 and the second terminal 17 are connected to each other. When the movable member 12 moves from the first position, the first terminal 16 and the second terminal 17 are disconnected from each other.

In addition to the detection method using the connection state of the terminals, an optical sensor, a touch sensor, or the like can also be used. Furthermore, the disconnection between the supply port and the supply portion can also be detected by electrically connecting the supply port 23 to the pressure supply port 22 and measuring the resistance between the supply portion 20 and the pressure supply portion 19. In each case, information is written in the information storage portion 21 after the detection mechanism determines that the supply port 23 is disconnected from the supply portion 20.

6. Attachment and Detachment of Liquid Container

The movable member 12 having the liquid container attached thereon is engaged with the supporting member 1 so as to be movable between the first position and the second position. At the first position, the supply port 23 and the supply portion 20 are connected to each other. In this state, information can be written in the information storage portion 21, and liquid can be supplied from the liquid container to the liquid discharging apparatus. At the second position, the liquid container can be attached to or detached from the apparatus. While the movable member moves from the first position to the second position, the supply port 23 is disconnected from the supply portion 20, and information is written in the information storage portion 21. The writing operation is finished before the movable member reaches the second position. That is, the second position is set such that the time required for the movable member 12 to move from the first position to the second position is longer than or equal to the time required for the information communication. Moreover, the liquid container 11 cannot be detached from the movable member 12 while the movable member moves from the first position to the second position.

Next, operations at each position will be described in detail.

6-1. First Position

Figure 3A:
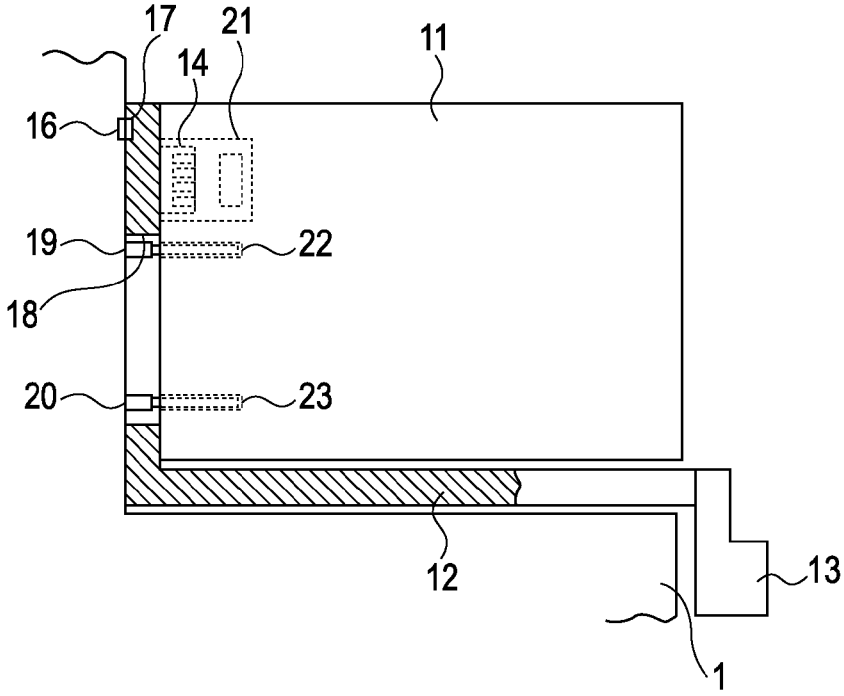
FIGS. 3A and 3B are schematic views of a liquid container, a movable member, and the supporting member at a first position and a second position, respectively, according to the first exemplary embodiment.

FIG. 3A illustrates the movable member 12 located at the first position where the liquid container 11 is attached to the supporting member 1. At the first position, the supply portion 20 and the pressure supply portion 19 of the liquid discharging apparatus are connected to the supply port 23 and the pressure supply port 22, respectively, of the liquid container. Moreover, the first terminal 16 and the second terminal 17 serving as the detection mechanism are also connected to each other.

6-2. Movement from First Position to Second Position

Figure 3B:
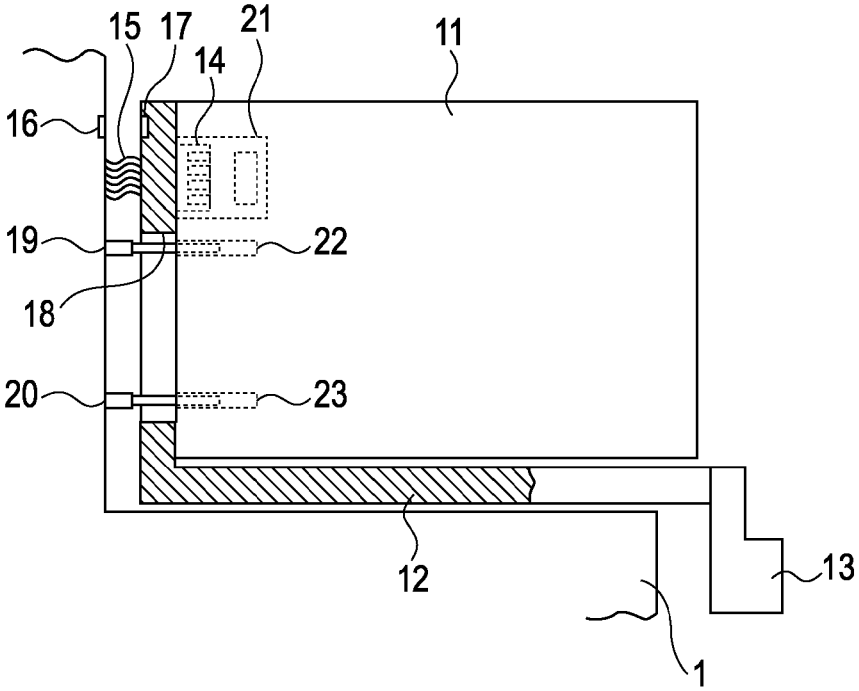

In order to detach the liquid container 11 from the apparatus, a user pulls it out using the knob 13 such that the movable member 12 moves from the first position to the second position shown in FIG. 3B. While the movable member 12 moves from the first position to the second position, the liquid container 11 cannot be detached from the apparatus. It is not until the movable member 12 reaches the second position that the liquid container 11 can be detached from the apparatus. In this exemplary embodiment, the user cannot detach only the liquid container from the apparatus at the first position when the movable member 12 is located at the first position since surface ends of the liquid container 11 and the liquid discharging apparatus are flat. Moreover, the liquid container 11 cannot be pulled out of the first position without using the knob 13.

While the movable member 12 moves from the first position to the second position, the connection between the supply portion 20 and the supply port 23 and the connection between the pressure supply portion 19 and the pressure supply port 22 are severed first. When the movable member 12 moves from the first position, the first terminal 16 and the second terminal 17 serving as the detection mechanism are disconnected from each other. With this, the movement of the movable member from the first position is detected, and it is determined that the connection of the supply port has been severed.

In response to this detection, information on the amount of liquid inside the liquid container is communicated (written) from the main body of the apparatus to the information storage portion 21 via the information terminal 14. The information on the amount of liquid inside the liquid container can be the amount of liquid being stored (remaining), the amount of liquid being consumed, or an amount obtained by counting the number of ejection. The series of these movements is performed while the movable member 12 moves from the first position to the second position.

The wiring member 15 that connects the movable member 12 and the supporting member 1 has a length large enough to ensure the electrical connection between the movable member 12 and the supporting member 1 even when the movable member moves 12 to the second position. Even when the movable member 12 moves from the first position to the second position, the information terminal 14 is electrically connected to the liquid discharging apparatus via the wiring member 15.

6-3. Second Position

FIG. 3B illustrates the liquid container at the second position where the liquid container is detachable from the supporting member. The second position is set such that the time required for the movable member 12 to move from the first position to the second position is longer than or equal to the time required for information communication with the information storage portion 21.

The time required for the information communication (retention) with the information storage portion 21 is about 10 to 100 milliseconds since the communication is electrically performed. When the time from when the user moves the movable member from the first position to the second position by pulling the knob 13 out to when the liquid container is detached from the apparatus is set to 200 to 500 milliseconds, or 1 second at longest, a sufficiently long writing time can be ensured. In order to ensure the writing time, the distance between the first position and the second position is preferably set to about 20 to 50 millimeters. Moreover, the time required for the movable member to move from the first position to the second position can be increased by applying a moving load to the movable member 12 using, for example, a spring, or the distance between the first position and the second position can be increased in view of operability.

6-4. Detachment of Liquid Container

FIG. 2 illustrates the liquid container 11 when it is detached from the apparatus. When the movable member moves to the second position shown in FIG. 3B, the liquid container becomes detachable. The liquid container 11 can be detached from the apparatus at this position.

6-5. Attachment of Liquid Container

When data can be transmitted between the information storage portion 21 and the information terminal 14 and the first terminal 16 and the second terminal 17 serving as the detection mechanism are connected to each other, it is determined that the liquid container 11 is attached to the supporting member 1. When the liquid container 11 is attached, information such as the amount of liquid being stored is read out of the information storage portion 21 of the liquid container 11 via the information terminal 14.

In this exemplary embodiment, information is written in the information storage portion after the liquid supply port is detached from the supporting member as described above, information can be written while the liquid supply from the liquid container is stopped. With this, even when the liquid container is detached from the apparatus while liquid still remains therein, a difference between the actual amount of liquid being stored in the liquid container and information on the amount of liquid being stored retained in the information storage portion can be reduced. Moreover, since the liquid container cannot be detached from the apparatus during the process of writing information while the movable member moves from the first position to the second position, information writing errors caused by detaching the liquid container 11 from the liquid discharging apparatus during the process of writing (retaining) information can be suppressed.

Figure 4:
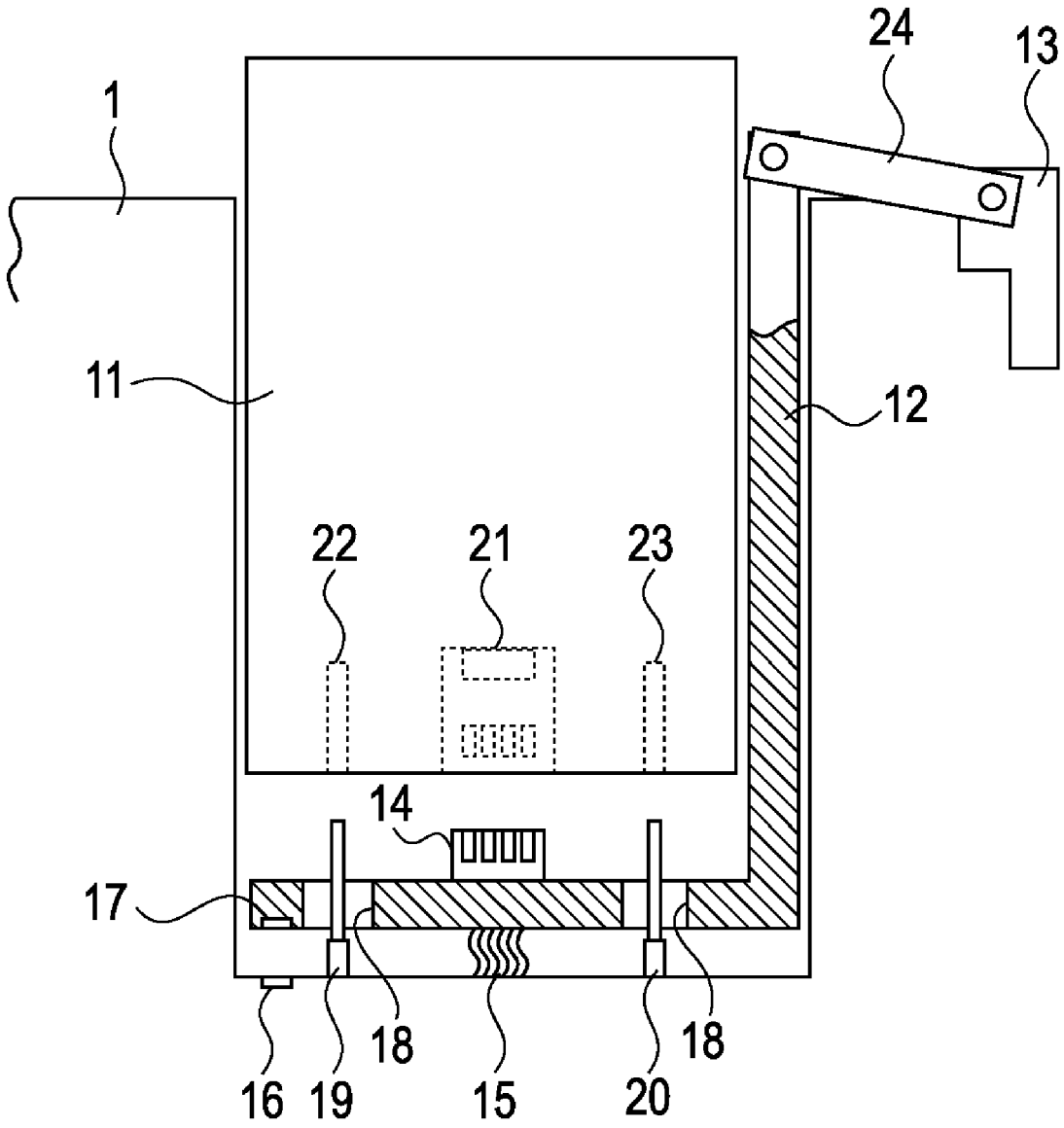
FIG. 4 is a schematic view of the supporting member, the movable member, and the liquid container according to a second exemplary embodiment of the present invention.

In a second exemplary embodiment of the present invention, the liquid container 11 is detached from the apparatus in a direction different from that in the first exemplary embodiment. Descriptions similar to those in first exemplary embodiment will be omitted. As shown in FIG. 4, the liquid container 11 is disposed such that a connection mechanism that connects the liquid container to the supporting member 1 is located below the liquid container in the direction of gravity while the liquid container is in use. The liquid container 11 can be attached to or detached from the apparatus by being vertically moved in the direction of gravity. The liquid container 11 can be detached from the apparatus by pushing the knob 13 down such that the movable member 12 is pushed up via a joint 24 provided for the knob 13 of the movable member 12. In this exemplary embodiment, the supply port is disconnected from the supply portion at the same time as when the movable member 12 moves from the first position, and the information terminal 14 stores information in the information storage portion 21 when the detection mechanism (the first terminal 16 and the second terminal 17) detects the disconnection.

Figure 5:
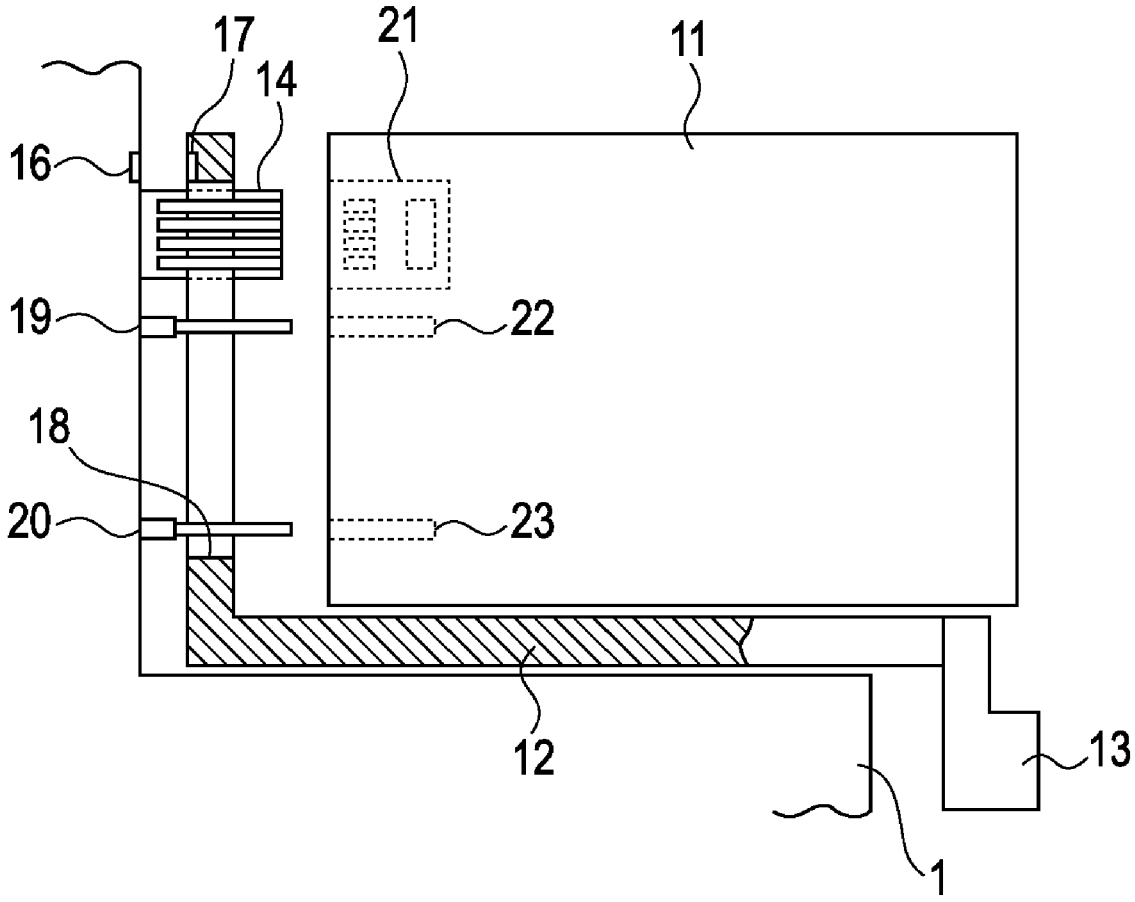
FIG. 5 is a schematic view of the supporting member, the movable member, and the liquid container according to a third exemplary embodiment of the present invention.

FIG. 5 illustrates an example structure according to a third exemplary embodiment of the present invention. In this exemplary embodiment, the structure of the information terminal 14 differs from those in the above-described exemplary embodiments. Instead of using the wiring member 15, the length of the information terminal 14 is increased such that the information terminal 14 and the information storage portion 21 are always connected to each other while a user moves the knob 13 between the first position and the second position.

Figure 6:
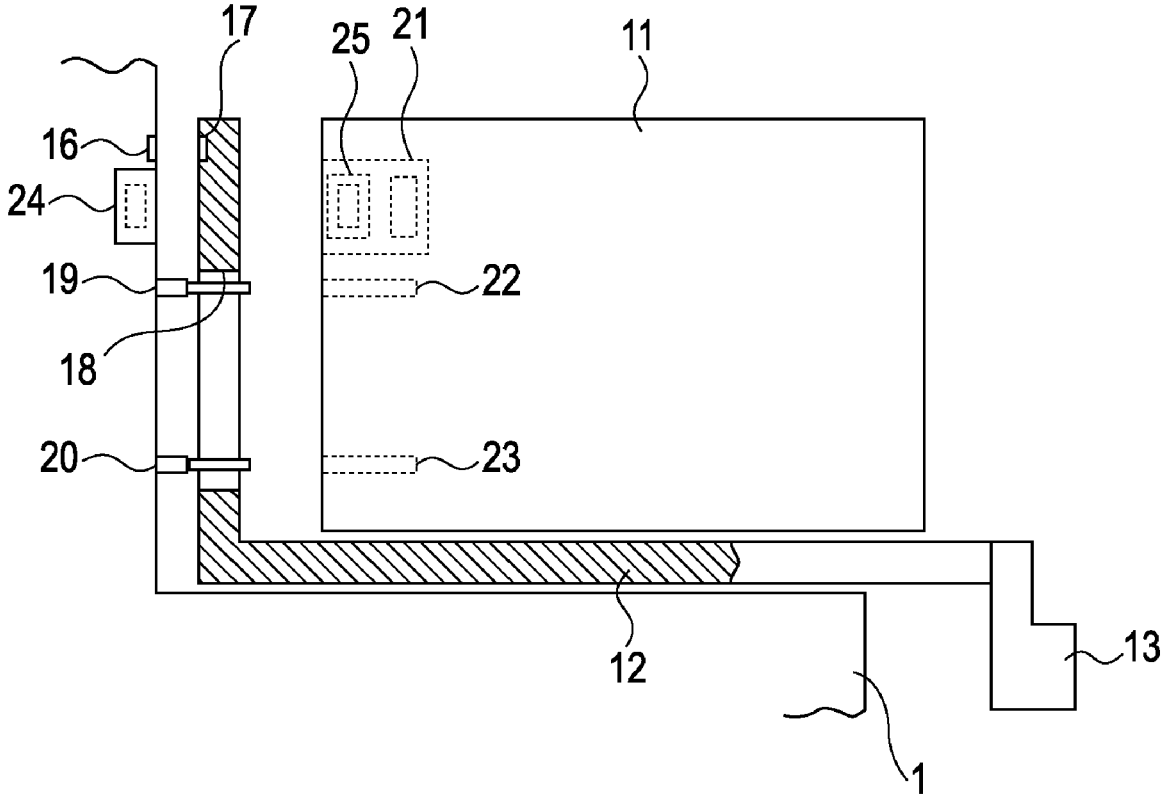
FIG. 6 is a schematic view of the supporting member, the movable member, and the liquid container according to a fourth exemplary embodiment of the present invention.
Figure 7A:
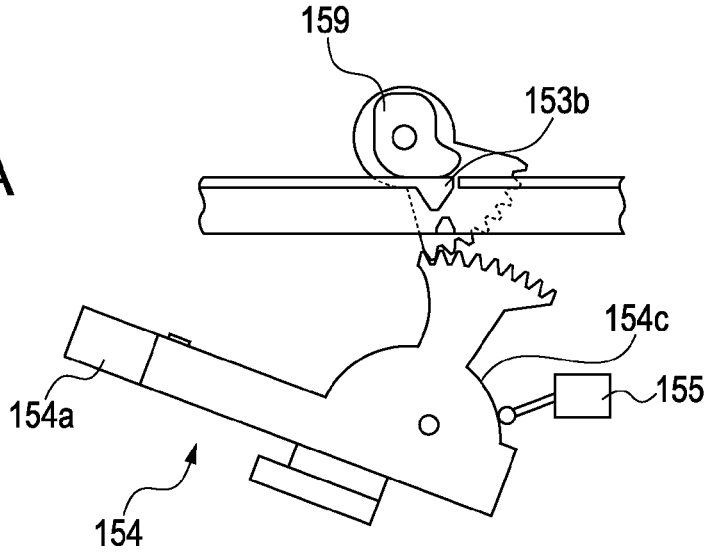
FIGS. 7A and 7B illustrate a structure for fixing a liquid container in a known liquid discharging apparatus.
Figure 7B:
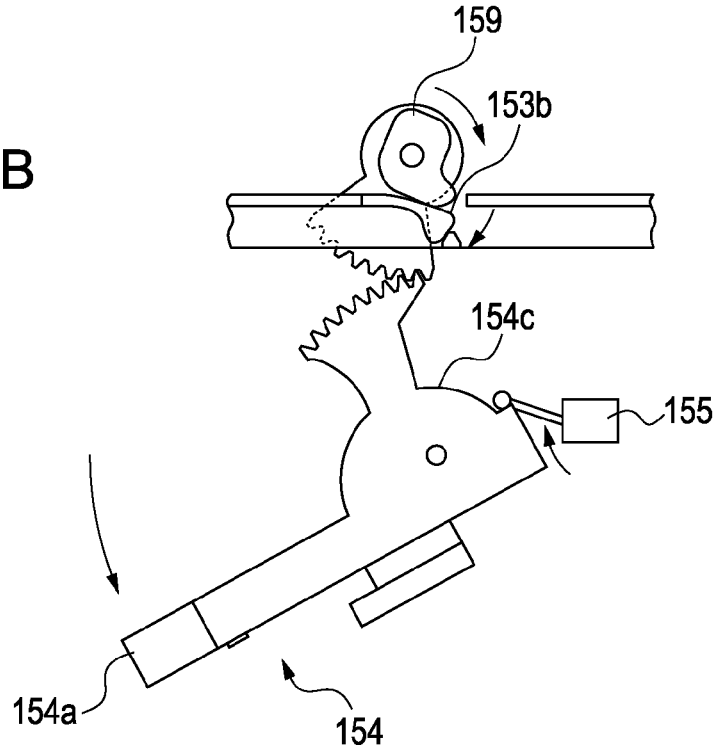

FIG. 6 illustrates an example structure according to a fourth exemplary embodiment of the present invention. This exemplary embodiment differs from the first to third exemplary embodiments in that a wireless communication portion is used.

The communication portion in this exemplary embodiment includes a wireless transmitter/receiver device 24 having an antenna capable of wireless communication. The information storage portion installed in the liquid container also includes a wireless transmitter/receiver 25 having an antenna capable of wireless communication. As regards the wireless transmitter/receiver and the transmitting/receiving method, Radio Frequency Identification (RFID) is generally known. Since structures other than this is the same as those in the above-described exemplary embodiments, the descriptions thereof will be omitted.

In this exemplary embodiment, the structures in the vicinity of the movable member can be simplified by omitting the wiring portion 15, and the reliability of writing information is improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Number 2008-324475, filed Dec. 19, 2008 which is hereby incorporated by reference herein in its entirety.

What is claimed is:

1. A liquid discharging apparatus comprising:

a liquid container including an information storage portion configured to store information on an amount of liquid in the liquid container and a supply port for supplying the liquid in the liquid container to the outside;

a communication portion configured to communicate the information between the information storage portion and the liquid discharging apparatus;

a supporting member including a supply portion, the supply portion configured to be connected to the supply port and to supply liquid to the liquid discharging apparatus; and a movable member, engaged so as to be movable with respect to the supporting member, having the liquid container attached thereon, wherein the movable member is movable from a first position at which the supply port and the supply portion are connected to each other to a second position at which the liquid container can be attached to or detached from the apparatus, wherein the communication portion communicates the information with the information storage portion after the connection between the supply port and the supply portion is severed while the movable member moves from the first position to the second position, wherein the second position is set such that a time required for the movable member to move from the first position to the second position is longer than or equal to a time required for the information communication, and wherein the communication portion includes:

an information terminal, disposed on the movable member, configured to be connected to the information storage portion; and a wiring portion configured to connect the information terminal to the supporting member.

2. The liquid discharging apparatus according to claim 1, further comprising a detection mechanism that detects the movement of the moveable member, wherein the detection mechanism detects the disconnection between the supply port and the supply portion.

3. The liquid discharging apparatus according to claim 1, wherein the information storage portion includes a wireless transmitter/receiver having an antenna capable of wireless communication, and the communication portion includes a wireless transmitter/receiver device having an antenna capable of wireless communication with the wireless transmitter/receiver.

* * * * *